US009995491B2

(12) United States Patent
Winkelmann

(10) Patent No.: US 9,995,491 B2
(45) Date of Patent: Jun. 12, 2018

(54) OVEN WITH AT LEAST ONE ILLUMINATED OVEN CAVITY

(75) Inventor: Klaus Winkelmann, Gedern (DE)

(73) Assignee: Electrolux Home Products Corporation N.V., Brussels (BE)

( * ) Notice: Subject to any disclaimer, the term of this patent is extended or adjusted under 35 U.S.C. 154(b) by 245 days.

(21) Appl. No.: 13/393,267

(22) PCT Filed: Sep. 16, 2010

(86) PCT No.: PCT/EP2010/005704
§ 371 (c)(1),
(2), (4) Date: Feb. 29, 2012

(87) PCT Pub. No.: WO2011/035868
PCT Pub. Date: Mar. 31, 2011

(65) Prior Publication Data

US 2012/0167865 A1 Jul. 5, 2012

(30) Foreign Application Priority Data

Sep. 26, 2009 (EP) ..... 09012251

(51) Int. Cl.
*F24C 15/00* (2006.01)
*F24C 15/08* (2006.01)

(52) U.S. Cl.
CPC ..... *F24C 15/008* (2013.01); *F24C 15/08* (2013.01)

(58) Field of Classification Search
CPC ..... F24C 12/008; F24C 12/08; A47J 37/0786; F21V 7/046; F21V 21/04; F21V 33/0044; F21V 33/0084
(Continued)

(56) References Cited

U.S. PATENT DOCUMENTS 2,164,239 A * 6/1939 Grayson ..... A21B 3/10 126/19 R
2,174,852 A * 10/1939 Taylor ..... 126/39 C
(Continued)

FOREIGN PATENT DOCUMENTS

DE 7900098 7/1979
DE 3808717 A1 * 9/1989 ..... F24C 15/008
(Continued)

OTHER PUBLICATIONS

International Search Report for PCT/EP2010/005704, dated Feb. 23, 2011, 2 pages.

*Primary Examiner* — Gregory Huson
*Assistant Examiner* — Martha Becton
(74) *Attorney, Agent, or Firm* — Pearne & Gordon LLP

(57) ABSTRACT

The present invention relates to an oven with at least one illuminated oven cavity (10). The oven cavity (10) comprises a top wall (12) with at least one embossing (22). The embossing (22) is arranged in a front portion of the top wall (12). The embossing (22) includes a surface section (24) with a cutout for latching a light emitting element (28) with a light source (38). The light source (38) is provided for generating a light cone (30). The embossing (22) includes an edge (26) in front of the surface section (24). Said edge (26) extends downwards and covers the light source (38) of the light source element (28), so that the light cone (30) is directed to the interior of the oven cavity (10). Alternatively, a bigger part of the light cone (30) is directed to the interior of the oven cavity (10) and a smaller part of the light cone (30) is directed to a lower part of an opening in the front side of the oven cavity (10).

20 Claims, 3 Drawing Sheets

Figure 1:
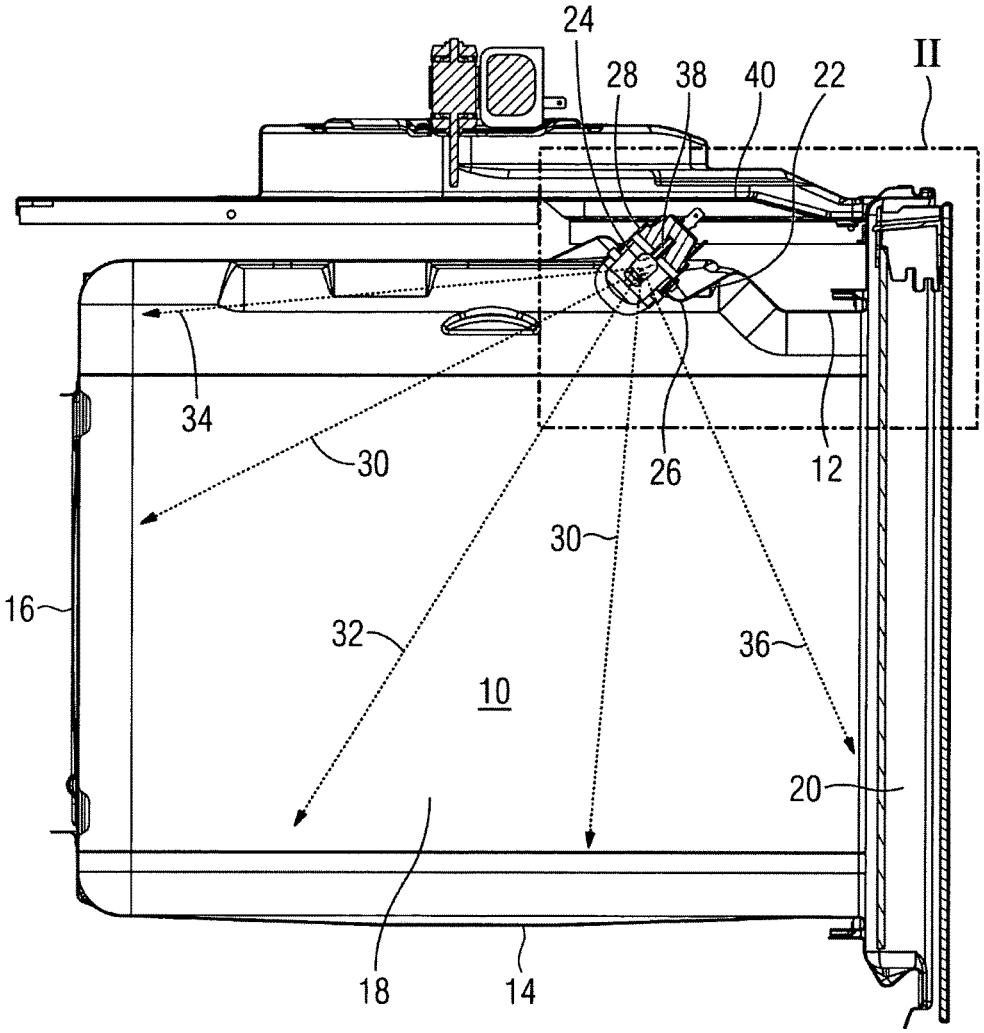

(58) Field of Classification Search
USPC ..... 126/19 R, 273 R; 219/758; 362/92
See application file for complete search history.

(56) References Cited

U.S. PATENT DOCUMENTS 2,301,697 A * 11/1942 Harbison ..... 362/92
2,687,125 A * 8/1954 Sherman ..... 126/200
2,809,282 A * 10/1957 Cripe et al. ..... 362/92
2,995,649 A * 8/1961 Cyrus ..... 362/92
4,621,180 A * 11/1986 Kristof ..... H05B 6/642 219/736
4,880,955 A * 11/1989 Nitzinger ..... A21B 3/10 126/19 R
5,149,930 A * 9/1992 Levoska et al. ..... 219/758
5,712,468 A * 1/1998 Ace ..... H05B 6/6444 219/715
5,747,783 A * 5/1998 Myung et al. ..... 219/758
5,768,898 A * 6/1998 Seok et al. ..... 62/132
5,873,646 A * 2/1999 Fjaestad et al. ..... 362/92
6,053,625 A * 4/2000 Bowker ..... 362/348
6,150,622 A * 11/2000 Malnati ..... 200/61.62
6,262,395 B1 * 7/2001 Coleman ..... 219/407
6,361,181 B1 * 3/2002 Bales ..... 362/92
6,508,574 B1 * 1/2003 Sara et al. ..... 362/297
D493,906 S * 8/2004 Park ..... D26/74
6,903,321 B2 * 6/2005 Kanzaki ..... H05B 6/6444 219/757
6,904,764 B2 * 6/2005 Bassi ..... 62/264
6,949,730 B2 * 9/2005 Lee ..... H05B 6/6444 126/299 R
7,157,667 B2 * 1/2007 Gramlich et al. ..... 219/391
7,717,106 B2 * 5/2010 Has et al. ..... 126/213
7,905,614 B2 * 3/2011 Aoki ..... 362/92
7,931,381 B2 * 4/2011 Balbinotti et al. ..... 362/92
8,070,309 B2 * 12/2011 Otsuki et al. ..... 362/126
8,215,795 B2 * 7/2012 Pichel ..... 362/249.02
8,405,003 B2 * 3/2013 Shaffer ..... F24C 15/008 126/19 R
2004/0000549 A1 * 1/2004 Lee ..... H05B 6/6444 219/758
2004/0240196 A1 * 12/2004 Wilsdorf et al. ..... 362/89
2004/0264168 A1 * 12/2004 Gotz et al. ..... 362/92
2005/0011511 A1 * 1/2005 Lappat et al. ..... 126/213
2006/0027574 A1 * 2/2006 Cho ..... 219/758
2006/0049188 A1 * 3/2006 Gramlich et al. ..... 219/723
2006/0266347 A1 * 11/2006 Gramlich et al. ..... 126/39 BA
2009/0071463 A1 * 3/2009 Ebert ..... F24C 15/008 126/273 R
2009/0207593 A1 * 8/2009 Otsuki et al. ..... 362/126
2010/0139638 A1 * 6/2010 Hargrave ..... F24C 15/008 126/19 R
2010/0154774 A1 * 6/2010 Balbinotti et al. ..... 126/273 R
2011/0056477 A1 * 3/2011 Leavens ..... 126/25 R
2012/0000455 A1 * 1/2012 Reinhard-Herrscher ..... F24C 15/008 126/19 R
2012/0167865 A1 * 7/2012 Winkelmann ..... F24C 15/08 126/19 R
2016/0040860 A1 * 2/2016 Thomas ..... A47F 3/001 362/92
2016/0138782 A1 * 5/2016 Sckenkl ..... F21V 14/04 362/92

FOREIGN PATENT DOCUMENTS

DE 10122878 A1 * 12/2002 ..... F24C 15/008
DE 10314543 10/2004
DE 10314543 A1 * 10/2004 ..... F24C 15/00
EP 0790755 8/1997
EP 790755 A2 * 8/1997 ..... H05B 6/76
EP 0790755 A2 * 8/1997 ..... H05B 6/6444
EP 2128526 A1 * 12/2009 ..... F24C 15/008
EP 2128527 A1 * 12/2009 ..... F24C 15/00
FR 2577028 A3 * 8/1986 ..... F25D 27/00
FR 2794219 A1 * 12/2000 ..... F21V 5/04
JP 05026454 A * 2/1993 ..... F24C 7/02

* cited by examiner

OVEN WITH AT LEAST ONE ILLUMINATED OVEN CAVITY

The present invention relates to an oven with at least one illuminated oven cavity according to claims 1 and 2.

Usually the cavity of an oven is illuminated. For example, one or more light sources are arranged at the top wall and/or the side walls of the oven cavity. However, the user can be dazzled by the light source, when he looks inside the oven cavity, either through an opening of the oven cavity or through a window of the closed oven door.

DE 1 794 381 U1 discloses a cooking oven with an illuminated oven cavity. A lamp is arranged in the front portion of the top wall. The lamp generates an asymmetric light distribution, so that only the oven cavity is illuminated. However, said asymmetric light distribution requires a very complex structure of the lamp.

DE 101 22 878 A1 describes an illuminating device for a cooking oven. A lamp is arranged inside of an asymmetric reflector attached on a cutout in the top wall of the oven cavity. The reflector is covered by a glass panel, so that the lamp is enclosed by the reflector and said glass panel. However, the lamp, the reflector and the glass panel have to be adapted to each other, so that a favoured light distribution can be obtained.

DE 38 08 717 A1 discloses an oven cavity with a pair of illumination devices. The illumination devices are arranged in the front portions of the side walls. The light sources are arranged inside the illumination devices behind glass panels. The glass panels are structured. The light sources are arranged in such a way, that light cones from the glass panels are substantially directed to the interior of the oven cavity.

It is an object of the present invention to provide an oven with at least one illuminated oven cavity, wherein the user cannot be dazzled by the light source and the construction of the oven cavity is not very complex.

The object of the present invention is achieved by the oven according to claim 1.

The present invention relates to an oven with at least one illuminated oven cavity, wherein:

- the oven cavity comprises a top wall with at least one embossing,
- the embossing is arranged in a front portion of the top wall,
- the embossing includes a surface section with a cutout for latching a light emitting element with a light source,
- the light source is provided for generating a light cone,
- the embossing includes an edge in front of the surface section, and
- said edge extends downwards and covers the light source of the light source element, so that the light cone is directed to the interior of the oven cavity.

The main idea of the present invention is the edge in front of the light source. Said edge acts as a cover and prevents the intervisibility between the light source and the user. The arrangement of the edge in front of the light source allows an arbitrary kind of light source element. A certain light distribution is not necessary. The light cone generated by the light source is completely inside the interior of the oven cavity. A glass panel or a lens in front the light source element is not necessary.

The object of the present invention is further achieved by the oven according to claim 2.

The present invention relates to an oven with at least one illuminated oven cavity, wherein:

- the oven cavity comprises a top wall with at least one embossing,

- the embossing is arranged in a front portion of the top wall,
- the embossing includes a surface section with a cutout for latching a light emitting element with a light source,
- the light source is provided for generating a light cone,
- the embossing includes an edge in front of the surface section, and
- said edge extends downwards and covers the light source of the light source element, so that a bigger part of the light cone is directed to the interior of the oven cavity and a smaller part of the light cone is directed to a lower part of an opening in the front side of the oven cavity.

The subject matter according to claim 2 differs from claim 1 by geometric properties of the light cone. A bigger part of the light cone is directed to the interior of the oven cavity and a smaller part of the light cone is directed to a lower part of an opening in the front side of the oven cavity. In an open state of the oven door said smaller part of the light cone extends outside of the oven cavity. However, the smaller part of the light cone does reach the position of the user.

According to the preferred embodiment of the present invention the surface section is inclined backwards, so that a centre axis of the light cone is directed to a lower portion of a rear wall of the oven cavity and/or to a rear portion of a bottom wall of the oven cavity. The inclined surface section allows a small height of the upper part of the oven cavity. Further, the inclined surface section allows that a centre axis of the light emitting element is directed to the rear and/or bottom portions of the oven cavity. Additionally, the inclined surface section allows an inclined light emitting element, which can be arranged below an air conduct, so that a cutout within the air conduct is not required.

For example, the light emitting element is a bulb. The bulb contributes to low cost for the use of the oven.

The light source may be a filament of the bulb. In particular, the edge covers the filament of the bulb, so that the light cone cannot directly dazzle a user of the oven. Thus, the edge covers the filament in such a way, that the filament is not visible for the user.

Further, the surface section includes a bulb holder for receiving the light emitting element. The bulb holder allows the use of standard light emitting elements, which contributes to low costs for the use of the oven.

According to the preferred embodiment of the present invention the top wall of the oven cavity and the embossing are formed as a single-piece part. This allows an easy production of the oven cavity.

Alternatively, the top wall, the bottom wall, the side walls and the embossing are formed as a single-piece part. This allows also an easy production of the oven cavity.

In particular, the oven is a cooking oven. The light cone allows further an optimized illumination of food stuff. There are not any shadows on the food stuff.

The novel and inventive features believed to be the characteristic of the present invention are set forth in the appended claims.

Figure 2:
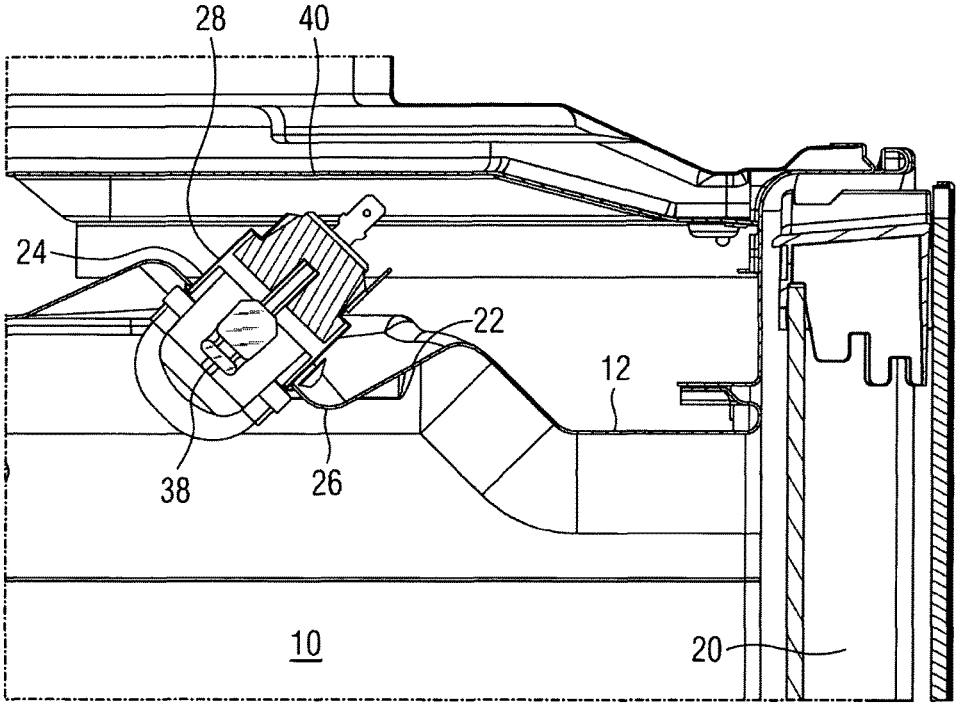
Figure 3:
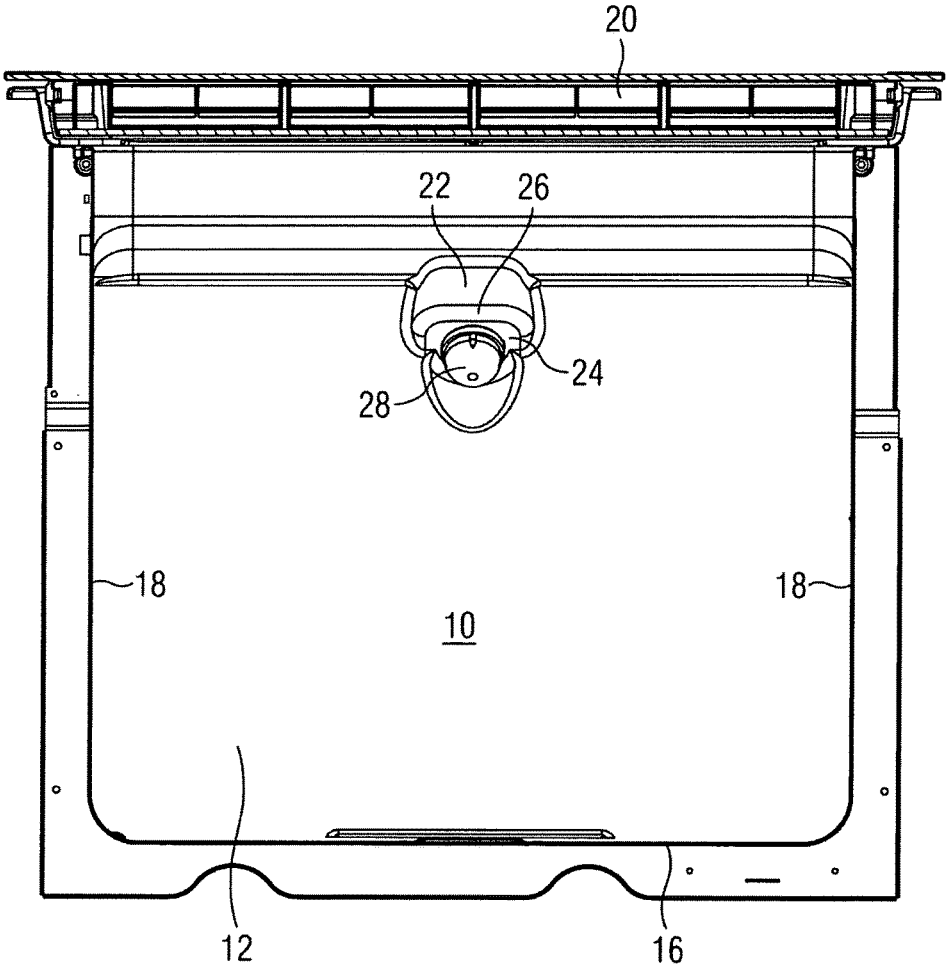

The invention will be described in further detail with reference to the drawings, in which FIG. 1 illustrates a schematic diagram of a sectional side view of an oven with an illuminated oven cavity according to a preferred embodiment of the present invention, FIG. 2 illustrates a schematic diagram of a detailed sectional side view of an embossing in a top wall of the oven cavity in FIG. 1 according to the preferred embodiment of the present invention, and FIG. 3 illustrates a schematic diagram of a bottom view of the top wall in the oven cavity according to the preferred embodiment of the present invention.

FIG. 1 illustrates a schematic diagram of a sectional side view of an oven with an illuminated oven cavity 10 according to a preferred embodiment of the present invention. The preferred embodiment of the present invention relates to a cooking oven. In general, the present invention relates to an arbitrary oven with an illuminated oven cavity 10.

The oven cavity 10 is bordered by a top wall 12, a bottom wall 14, a rear wall 16 and two side walls 18. At the front side the oven cavity 10 comprises an opening. The opening of the oven cavity 10 is covered by an oven door 20. FIG. 1 shows a closed state of the oven door 20.

The top wall 12 of the oven cavity 10 comprises an embossing 22. The embossing 22 is arranged in a front portion of the top wall 12. A surface section 24 of the embossing 22 is plane and inclined to the rear portion of the oven cavity 10.

In the centre of the surface section 24 a cutout is formed. Said cutout is provided for receiving and latching a light emitting element 28. In this example, the light emitting element is a bulb 28. Since the surface section 24 is inclined, the centre axis of the bulb 28 is directed to the rear and lower portion of the oven cavity 10. A light source 38 is arranged in the centre of the bulb 28. In this example, the light source 38 is the filament of the bulb 28.

The inclined surface section 24 has the effect, that the centre axis of the bulb 28 is directed to the rear and lower portion of the oven cavity 10. The inclined surface section 24 has the further effect, that the portion of the top wall 12 and the upper part of the oven cavity may be formed with a small height.

The embossing 22 comprises an edge 26 arranged between the surface section 24 and the opening of the oven cavity 10. In this example, the edge 26 forms the front end of the surface section 24. In general, the edge 26 is arranged in front of the surface section 24.

The edge 26 shrouds the bulb 28 partially and the light source 38 completely, so that the proper light source 38 is not visible by a user being in front of the oven and watching the oven cavity 10 from an outer side.

A light cone 30 generated by the filament of the bulb 28 is substantially directed to the interior of the oven cavity 10. A central light beam 32 of the light cone 30 is directed to a rear portion of the bottom wall 14. Rear light beams 34 of the light cone 30 are directed to the rear wall 16 of the oven cavity 10. Front light beams 36 of the light cone 30 are directed to the lower portion of the opening or the oven door 20, respectively.

An air conduct is arranged above the oven cavity 10 and the embossing 22. A lower part 40 of said air conduct is directly arranged above the embossing 22.

FIG. 2 illustrates a schematic diagram of a detailed sectional side view of the embossing 22 in the top wall 12 of the oven cavity 10 in FIG. 1 according to the preferred embodiment of the present invention.

FIG. 2 shows in detail the arrangement of the embossing 22 in the top wall 12 of the oven cavity 10. The surface section 24 of the embossing 22 is inclined to the rear portion of the oven cavity 10. The bulb 28 is received and latched by the cutout in the surface section 24. Since the surface section 24 is inclined, the bulb 28 is also inclined. The centre axis of the bulb 28 is directed to the rear and lower portions of the oven cavity 10.

The edge 26 of the embossing 22 is arranged between the surface section 24 and the front of the top wall 18. In the preferred embodiment the edge 26 forms the front end of the surface section 24. The edge 26 shrouds the filament of the bulb 28. Thus, the filament of the bulb 28 is not visible by a user being in front of the oven and watching the oven cavity 10 from the outer side.

FIG. 3 illustrates a schematic diagram of a bottom view of the top wall 12 in the oven cavity 10 according to the preferred embodiment of the present invention. FIG. 3 clarifies further geometric properties of the oven cavity 10 and the embossing 22.

The embossing 22 is arranged in the centre between the two side walls 18. However, the distance between the embossing 22 and the oven door 20 is closer than the distance between the embossing 22 and the rear wall 16. Thus, the light cone 30 is substantially directed to the rear wall 16 and to the bottom wall 14.

The edge 26 of the embossing 22 is arranged between the surface section 24 and the opening of the oven cavity 10. In this example, the edge 26 forms the front end of the surface section 24.

In general, the edge 26 is arranged in front of the surface section 24.

The edge 26 shrouds partially the bulb 28. The light source 38 is completely shrouded by the edge 26, so that the proper light source 38 is not visible by the user being in front of the oven and watching the oven cavity 10 from the outer side.

The embossing 22 with the surface section 24 and the edge 26 according to the present invention allows the use of a standard bulb 28. No special light emitting elements are required. This contributes to low costs for the use of the oven.

Further, the embossing 22 with the surface section 24 and the edge 26 according to the present invention can be easily produced. This contributes to low costs for the oven itself.

Although illustrative embodiments of the present invention have been described herein with reference to the accompanying drawings, it is to be understood that the present invention is not limited to those precise embodiments, and that various other changes and modifications may be affected therein by one skilled in the art without departing from the scope or spirit of the invention. All such changes and modifications are intended to be included within the scope of the invention as defined by the appended claims.

LIST OF REFERENCE NUMERALS

10 oven cavity
12 top wall
14 bottom wall
16 rear wall
18 side wall
20 oven door
22 embossing
24 surface section
26 edge
28 light emitting element, bulb
30 light cone
32 central light beam
34 rear light beams
36 front light beams
38 light source
40 lower part of an air conduct

The invention claimed is:

1. An oven comprising an oven cavity, said oven cavity comprising:

a front opening;

a rear wall facing the front opening;

a top wall connecting the front opening and the rear wall;

two side walls facing each other and connected to the rear wall and the top wall;

an embossing formed in the top wall close to the front opening, a front portion of the top wall connecting the embossing to the front opening, said front portion having a front horizontal surface connected to the front opening, and an upward sloping surface connecting the front horizontal surface to the embossing;

a rear portion of the top wall connecting the embossing to the rear wall;

said embossing having:

a surface section;

an upward bending curved section between the surface section and the rear portion of the top wall to provide a recess above the top wall;

a protrusion between the surface section and the upward sloping surface of the front portion of the top wall, wherein the protrusion extends downwards towards an interior of the oven cavity; and a cutout within the surface section; and a light emitting element extending into the oven cavity through the cutout, said light emitting element comprising a light source configured to generate a light cone;

wherein the protrusion shrouds the light emitting element partially and the light source completely on a side of the light emitting element facing the front opening, and wherein the embossing is formed by the top wall.

2. The oven according to claim 1, wherein the embossing is arranged in a center portion of the front portion of the top wall.

3. The oven according to claim 2, wherein the protrusion extends only along the center portion of the front portion of the top wall.

4. The oven according to claim 1, wherein the light emitting element is a bulb.

5. The oven according to claim 4, wherein the light source is a filament of the bulb.

6. The oven according to claim 1, wherein said protrusion extends downwards and covers the light source of the light emitting element, so that a bigger part of the light cone is directed to the interior of the oven cavity and a smaller part of the light cone is directed to a lower part of the front opening in a front side of the oven cavity.

7. The oven according to claim 1, wherein the surface section is inclined backwards, so that a center axis of the light cone is directed to at least one of a lower portion of the rear wall of the oven cavity and a rear portion of a bottom wall of the oven cavity.

8. The oven according to claim 1, wherein the protrusion covers the light source of the light emitting element, so that the light cone cannot dazzle a user of the oven.

9. The oven according to claim 1, wherein the surface section includes a holder for receiving the light emitting element.

10. The oven according to claim 1, wherein the top wall of the oven cavity and the embossing are a single-piece part.

11. The oven according to claim 1, wherein the top wall, a bottom wall, side walls, and the embossing are a single-piece part.

12. The oven according to claim 1, wherein the oven is a cooking oven.

13. The oven according to claim 1, further comprising an air duct arranged along the top wall at least partially above the embossing.

14. The oven according to claim 1, further comprising a door for opening and closing the front opening of the oven cavity, wherein the door comprises a transparent window.

15. The oven according to claim 14, wherein the protrusion covers the light source of the light emitting element, so that the light cone is directed to the interior of the oven cavity and wherein the light cone cannot dazzle a user of the oven when the user views the oven cavity either through the transparent window or when the door is in an open position.

16. The oven according to claim 1, wherein the protrusion extends downwards from the surface section only in a region corresponding to the light emitting element.

17. The oven according to claim 1, wherein the protrusion extends downwards from the surface section only in a region corresponding to the light source.

18. The oven according to claim 1, wherein the protrusion is formed by the top wall.

19. The oven of claim 1, wherein the front portion of the top wall has a width that is similar to the width of the embossing measured from side to side, and the embossing extend only a portion of the top wall between the two side walls.

20. The oven of claim 1, wherein a lower portion of said protrusion extends below the light source to hinder the light cone generated by the light source from illuminating an upper portion of the front opening of the oven cavity.

* * * * *